US008820771B2

(12) United States Patent
Farges

(10) Patent No.: US 8,820,771 B2
(45) Date of Patent: Sep. 2, 2014

(54) SAFETY FASTENING HEELPIECE FOR SKI BOOT

(75) Inventor: Frederic Farges, Moirans (FR)

(73) Assignee: Skis Rossignol, Saint-Jean-de-Moirans (FR)

( * ) Notice: Subject to any disclaimer, the term of this patent is extended or adjusted under 35 U.S.C. 154(b) by 183 days.

(21) Appl. No.: 13/480,061

(22) Filed: May 24, 2012

(65) Prior Publication Data

US 2012/0299255 A1 Nov. 29, 2012

(30) Foreign Application Priority Data

May 27, 2011 (FR) ..... 11 54622

(51) Int. Cl.
*A63C 9/00* (2012.01)
*A63C 9/084* (2012.01)

(52) U.S. Cl.
CPC ..... *A63C 9/0844* (2013.01); *A63C 9/0848* (2013.01); *A63C 9/0846* (2013.01)
USPC ..... 280/611; 280/623; 280/632

(58) Field of Classification Search
CPC ..... A63C 10/24; A63C 10/18; A63C 9/00; A63C 9/005; A63C 9/08521; A63C 9/08564; A63C 9/0846; A63C 9/0842
USPC ..... 280/611, 623, 625, 14.22, 631, 632
See application file for complete search history.

(56) References Cited

U.S. PATENT DOCUMENTS

| | | | | | |
|---|---|---|---|---|---|
| 3,173,701 | A | * | 3/1965 | Beyl | 280/626 |
| 3,734,520 | A | * | 5/1973 | Hashioka | 280/632 |
| 3,810,644 | A | * | 5/1974 | Beyl | 280/632 |
| 4,097,062 | A | * | 6/1978 | Salomon | 280/618 |
| 4,552,378 | A | * | 11/1985 | Svoboda | 280/632 |
| 4,602,804 | A | * | 7/1986 | Spitaler et al. | 280/632 |
| 4,625,991 | A | * | 12/1986 | Leichtfried | 280/632 |
| 4,795,185 | A | * | 1/1989 | Hornschemeyer | 280/632 |
| 4,804,201 | A | * | 2/1989 | Stritzl et al. | 280/618 |
| 4,863,186 | A | * | 9/1989 | Rullier et al. | 280/626 |

(Continued)

FOREIGN PATENT DOCUMENTS

| | | |
|---|---|---|
| EP | 0 893 146 A | 1/1999 |
| EP | 1 900 400 A | 3/2008 |
| EP | 2 168 640 A | 3/2010 |

OTHER PUBLICATIONS

Search report issued by French Patent Office for priority application FR 11 54622 dated Jan. 31, 2012.

*Primary Examiner* — J. Allen Shriver, II
*Assistant Examiner* — James M Dolak
(74) *Attorney, Agent, or Firm* — Frommer Lawrence & Haug LLP; Ronald R. Santucci

(57) ABSTRACT

Safety fastening heelpiece (10) for ski boot comprising a moving body (11) mounted to pivot about an articulation axis (14) suspended by two lateral arms (20) linked to a base (12), the moving body including a release spring (15) acting on a moving piston (17) cooperating with a release surface (18) of the articulation axis, so as to be able to occupy a first position corresponding to a closed position of the heelpiece in which a heel grip (13) arranged at one end of the moving body is intended to hold the heel of a ski boot on the ski, and to be able to occupy a second position corresponding to an open position of the heelpiece, characterized in that the release surface is formed by a protrusion (21) arranged in relief relative to the rest of the articulation axis.

24 Claims, 5 Drawing Sheets

(56) References Cited

U.S. PATENT DOCUMENTS

| | | | | | |
|---|---|---|---|---|---|
| 4,998,747 | A * | 3/1991 | Dimier et al. | 280/631 |
| 5,005,854 | A * | 4/1991 | Szafranski | 280/626 |
| 5,326,127 | A * | 7/1994 | Mercat et al. | 280/632 |
| 5,378,009 | A * | 1/1995 | Dogat | 280/630 |
| 5,913,531 | A * | 6/1999 | Buquet | 280/626 |
| 6,206,404 | B1 * | 3/2001 | Buquet et al. | 280/624 |
| 6,296,267 | B1 * | 10/2001 | Buquet | 280/626 |
| 7,267,356 | B2 * | 9/2007 | Buquet et al. | 280/616 |
| 7,900,951 | B2 * | 3/2011 | Farges | 280/623 |

* cited by examiner

SAFETY FASTENING HEELPIECE FOR SKI BOOT

TECHNICAL FIELD OF THE INVENTION

The invention relates to a safety fastening heelpiece of "moving body" type for ski boots, that is to say, a device intended to securely hold the rear of a boot on a ski by exerting a pressure on the heel of the boot while pressing all of the boot forward against a front abutment device, while ensuring an automatic release of the heel of the boot in case of a forward fall of the skier under the effect of the application by the heel on the heelpiece of a release force greater than a predetermined threshold.

It also relates to a fastening device comprising an abutment to receive the front portion of a ski boot and such a heelpiece, as well as a ski on which such a heelpiece is fastened.

STATE OF THE ART

A first family of heelpieces, called "fixed body", relies on a fixed body comprising the mechanism for releasing the heelpiece and on a very simple distinct element, which moves rotationally relative to this body, of lever type, comprising, at its front end, a jaw to grip the heel of the ski boot. The rotation of this lever relative to the fixed body allows the heelpiece to occupy two positions, closed and open, to respectively fasten or release the heel of the boot.

However, this fastening heelpiece family has the main drawback that the essential functions of the fastening, namely the position setting function and the release function, are combined in a single body, which makes design and maintenance difficult.

The present invention focuses on a second family of heelpieces, called "moving body", which relies on a moving body which can occupy a closed position and an open position, and which incorporates a release mechanism. This moving body comprises, at its front end, a jaw to grip the heel of a boot in the closed position and, in its rear portion, the release mechanism which enables the rear of the boot to be released in case of a significant force as is the case in a forward fall of the skier. The body is mounted to pivot about a suspended axis linked to the heelpiece, to occupy either the closed position for skiing or the open position in which the skier can remove his or her boot from the heelpiece. This type of heelpiece, described for example by the document EP0893146, enables the fastening to be released with very high forces, which are particularly suited to competition skiing.

The document EP1900400 describes another solution in which the rotation axis of the moving body is suspended by its ends by virtue of two lateral arms extending from the base, in the manner of an inverted U-shaped bracket. It has a section with significant dimensions, which induces a cooperation with a heel grip and a moving body of significant volumes and, more generally, a very bulky heelpiece. In this construction, the articulation axis is externally provided with a release surface. Because of the large dimensions of the section of the articulation axis, the known solution for forming the release surface consists in providing an overall planar form of flat type, hollowed relative to the rest of the cylindrical piece forming the articulation axis.

However, this type of heelpiece described previously has the following drawbacks:

- the articulation axis, because of its large section and the necessity for metal, is heavy, complex and costly,
- the articulation axis, because of its large section, is bulky, notably towards the front of the heelpiece. The result of this is that the lever arm of the heel grip is large, implying a need for great stiffness of the spring of the release mechanism implying a bulky and heavy moving body and related difficulties when removing the boot.

OBJECT OF THE INVENTION

The aim of the present invention is to propose a heelpiece of "moving body" type according to the second family, that is to say one that implements a suspended articulation axis, which retains the above mentioned advantages but does not have the drawbacks thereof.

More specifically, the present invention seeks for a moving body heel piece solution that is simpler, less heavy, less bulky, and more user-friendly for boot removal.

To this end, the invention relies on a safety fastening heelpiece for ski boot comprising a moving body mounted to pivot about an articulation axis suspended by two lateral arms linked to a base, the moving body including a release spring acting on a moving piston cooperating with a release surface of the articulation axis, so as to be able to occupy a first position corresponding to a closed position of the heelpiece in which a heel grip arranged at one end of the moving body is intended to hold the heel of a ski boot on the ski, and to be able to occupy a second position corresponding to an open position of the heelpiece, characterized in that the release surface is formed by a protrusion arranged in relief relative to the rest of the articulation axis.

The articulation axis may be formed in an overall cylindrical piece, the ratio between the radius (r1) of the articulation axis at the summit of the protrusion and the radius (r2) over the rest of the articulation axis is greater than 1.5, or greater than 1.7.

The release spring (15) has a stiffness in accordance with at least one of the following properties:

- for a setting up to Z12 of the heelpiece, the stiffness is less than 200 N/mm, or less than 150 N/mm, or less than or equal to 120 N/mm; and/or
- for a setting up to Z15 of the heelpiece, the stiffness is less than 300 N/mm, even less than 200 N/mm, even less than or equal to 150 N/mm.

The protrusion may extend over at least a portion of the length of the articulation axis in the transversal direction y and extends longitudinally substantially towards the rear of the heelpiece.

The moving body may include a through-opening of non-circular form to receive the articulation axis with its protrusion, and this opening may be at least partially covered by an arm.

In a cross-sectional plane having a normal oriented in the transversal direction, the protrusion may have an overall triangular section, with a rounded summit surrounded by two slopes, respectively upper and lower.

The upper slope may be rectilinear and extend substantially in the longitudinal direction (x).

The direction (D1) of the upper slope may form an angle ($\alpha$1) less than 20 degrees relative to a horizontal plane (P).

The lower slope may be rectilinear and extend in an inclined direction (D2) approaching the base by going longitudinally towards the front of the heelpiece.

The lateral arms may delimit a space between the transversal ends of the protrusion and themselves so as to be able to receive a portion of the moving body.

The lateral arms may include openings to receive an end of the articulation axis.

The openings of the lateral arms may have a section that is smaller than the section of the articulation axis at the level of its protrusion so that this articulation axis cannot pass through an opening.

The articulation axis may be blocked transversally at the level of each lateral arm by a stop washer fitted into the opening of the arm, the washer being equipped, on the periphery of its internal face, with a double series of rotation blocking elements cooperating respectively with elements for blocking the opening of the lateral arms and with complementary blocking elements linked to the articulation axis.

The articulation axis may be of plastic material, or of fibre-reinforced plastic material.

The articulation axis may adopt an overall tubular form and a reinforcing insert may be arranged inside the articulation axis so as to reinforce the heelpiece.

The invention also relates to a device for fastening a ski boot on a ski, comprising an abutment to receive the front portion of a ski boot, and characterized in that it comprises a heelpiece as described above to receive the rear portion of the ski boot.

The invention also relates to a ski comprising a safety fastening heelpiece for ski boots as described above.

BRIEF DESCRIPTION OF THE DRAWINGS

Other advantages and features will become more clearly apparent from the following description of particular embodiments of the invention, given as non-limiting examples, and represented in the appended drawings, in which.

DESCRIPTION OF PREFERRED EMBODIMENTS OF THE INVENTION

To assist in understanding the rest of the description, we define the longitudinal direction x as the horizontal direction extending from the front to the back of the heelpiece, the transversal direction y as the horizontal direction perpendicular to the direction x, the vertical direction z perpendicular to the horizontal plane defined by the x and y axis, oriented upwards.

The heelpiece 10 according to the embodiment of the invention comprises a moving tubular body 11 mounted to pivot about a suspended articulation axis attached to a carriage by its lateral ends. The carriage is suitable for mounting on a ski, via slideways formed on the lateral portions of a bottom base 12 of the carriage, in order to allow its longitudinal position to be adjusted on a ski to adapt it to different boot sizes. The moving body 11 comprises, in its forward portion, a "heel grip" 13 suitable for holding the standardized rear heel of a ski boot.

Figure 1:
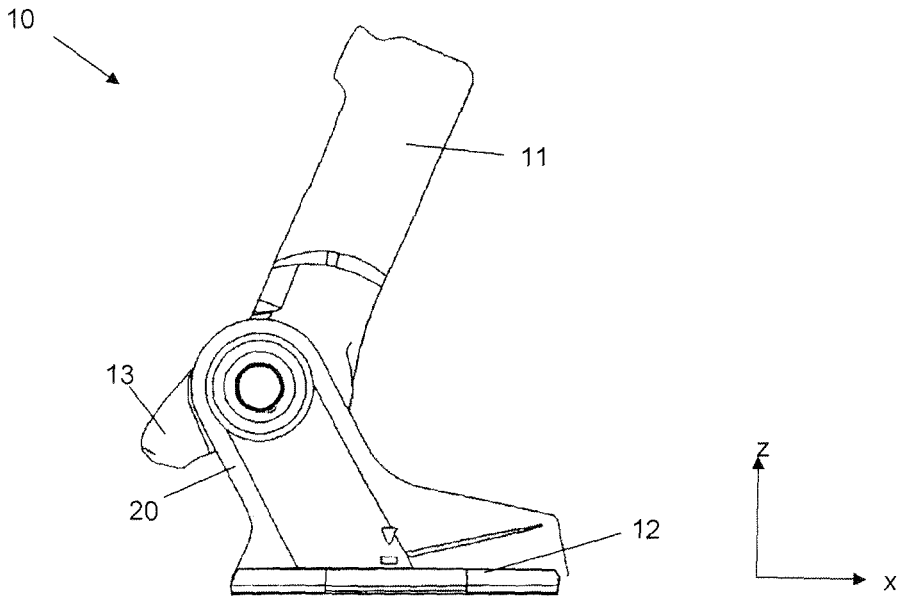
FIGS. 1 and 2 illustrate an exemplary heelpiece according to the invention in the closed position, respectively from the side and in longitudinal cross section.
Figure 2:
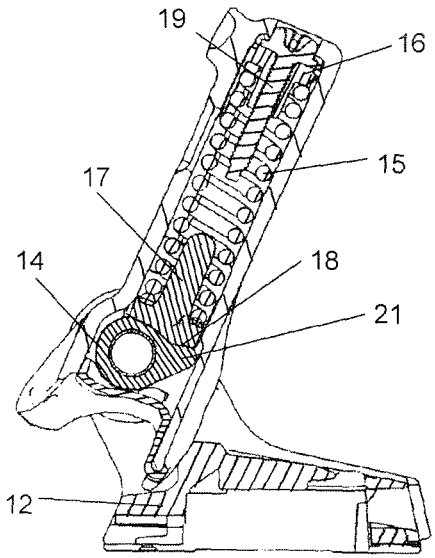
Figure 3:
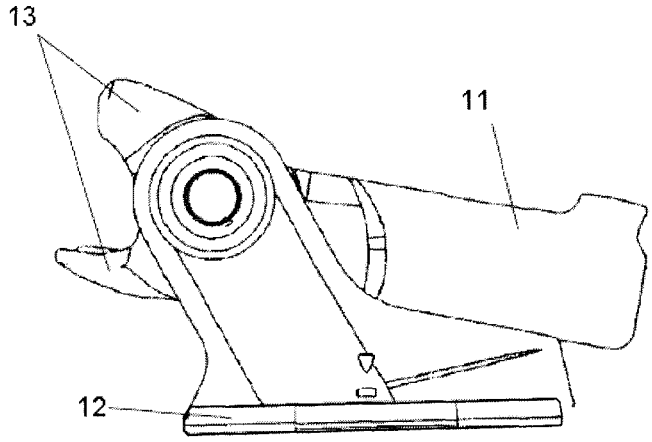
FIGS. 3 and 4 illustrate the heelpiece in the open position, respectively from the side and in longitudinal cross section.
Figure 4:
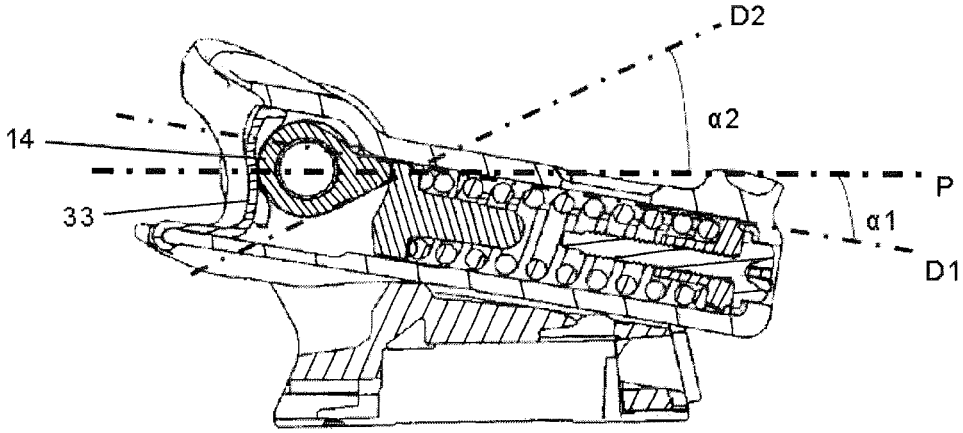

The moving body 11, which can be seen more particularly in FIGS. 1 to 4, encloses a release mechanism which allows for the automatic transition of the heelpiece from the closed position configuration for skiing, represented in FIGS. 1 and 2, to the open position represented in FIGS. 3 and 4, in which the ski boot can escape from the grip of the heelpiece, notably from the heel grip 13. This release is automatically implemented in the case of a release force transmitted by the heel of the boot to the heel grip 13 which is greater than a predetermined threshold, for example in the case of a forward fall of the skier. The moving body 11 switches from the closed configuration corresponding to the closed position of the heelpiece 10 to the open configuration corresponding to the open position of the heelpiece by a pivoting movement relative to the carriage, about an articulation axis 14.

To implement the release function, the moving body 11 comprises various elements in its internal volume, including a release spring 15 bearing against the abutment 16 in the top rear portion of the body 11 and bearing on a piston 17 at its other end. This piston 17 cooperates with a release surface 18 provided on the articulation axis, detailed hereinbelow. The release threshold can be modified continuously by modifying the degree of compression of the spring 15 by an adjusting screw 19 positioned at the rear end of the moving body 11 and capable of displacing the abutment 16 internally along the moving body 11. The moving body 11 thus has the particular feature of being closed in a tight manner downwards, from its heel grip 13 to all of the travel of the piston 17. A bottom 33 can be added in a tight and removable manner inside the heel grip 13 on the moving body 11 to close an opening intended for the fitting of the release mechanism inside the moving body 11.

The release surface 18 is borne externally by the articulation axis 14, which is suspended, that is to say held on the base only at its two lateral ends and not in its central portion, by two lateral arms 20 which each extend from the base 12 by being offset from one another in the transversal direction y by a spacing substantially equal to the width of the heel grip. The main function of the lateral arms 20 is to take up and support the forces transmitted to the articulation axis 14 at the release surface 18 under the action of its cooperation with the moving piston 17, the spring 15 acting on this piston during its movement relative to the release surface 18.

Figure 9:
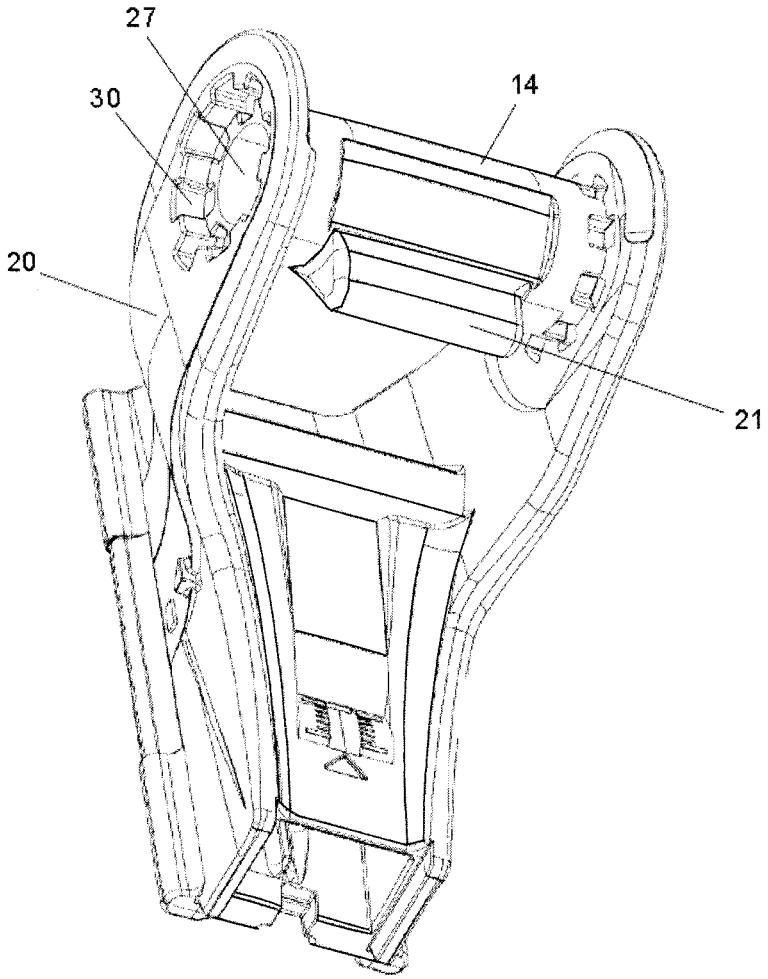
FIG. 9 is a perspective view of the carriage and of the articulation axis used in the heelpiece of the preceding figures.

The embodiment of the invention provides for the release surface 18 to be formed by a protrusion 21 of the articulation axis, which can be seen particular in FIGS. 2, 4 and 9. This protrusion is present at least in the central portion of the articulation axis, is oriented toward the rear of the heelpiece so as to cooperate with the piston of the release mechanism, globally on the side opposite the heel grip 13 relative to the articulation axis 14. It forms a volume in relief outside the cylinder in which the portion of the articulation axis arranged towards the front of the heelpiece is inscribed. The protrusion 21 is therefore arranged in relief relative to the rest of the articulation axis 14. It can be seen in particular in FIGS. 6 and 7. It may notably extend over at least a portion of the length of the articulation axis 14 in the transversal direction y. In the example represented, its section is constant along the articulation axis 14. It fulfils an additional function of reinforcing the articulation axis 14 in the manner of a strengthening rib in addition to its main release function. The rigidity thus imparted by the protrusion 21 advantageously makes it possible to provide relatively small dimensions for the section of the articulation axis 14 outside of the protrusion area. Also, it even makes it possible to consider the use of an economical and lightweight material, such as a simple plastic for example, possibly reinforced with glass fibres or any equivalent. This solution further becomes less costly than the prior art solutions which require the use of a metal piece. The protrusion 21 is advantageously part of the articulation axis, which forms a monolithic element. In a variant, the protrusion 21 could be a distinct element fixed on the articulation axis, which could be cylindrical or quasi cylindrical, in order to obtain finally a result equivalent to previous axis with protrusion.

Figure 6:
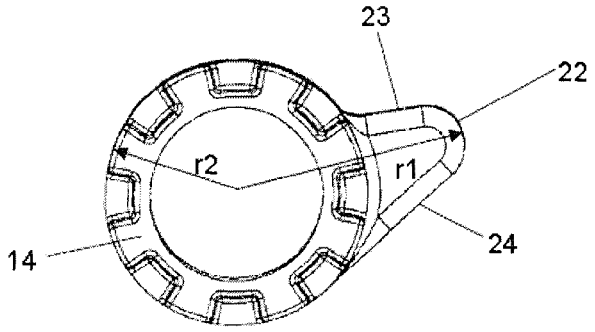
FIGS. 6 and 7 are side and perspective views of the articulation axis of the heelpiece of the preceding figures.
Figure 7:
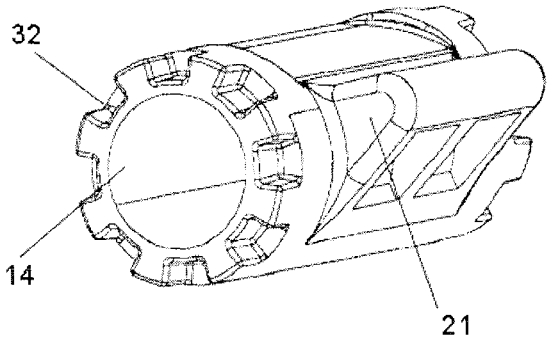

Referring to FIG. 6, the protrusion 21 may be configured so as to have, in a cross-sectional plane (x, z) having a normal oriented in the transversal direction y, an overall triangular section, with a rounded summit 22 forming a switchback point on which the piston remains pressed in the open position. It is surrounded by two slopes 23, 24, respectively upper and lower. The piston bears on the upper slope 23 in the closed position of the heelpiece. These slopes can have any general form provided that it is suitable for the desired function, for example of concave or convex form. As illustrated, the upper slope 23 may be rectilinear, so that the release surface 18 has a planar upper surface. Similarly, the lower slope 24 may be rectilinear, or may comprise a greater volume of material, extending downwards under the straight line D2 for example, so as to increase the rigidity of the articulation axis.

The form, the length and the orientation of the slopes 23, 24 can be adapted according to the desired result in terms of release characteristics (for example, the value of the predetermined release threshold, or the angular amplitude of the moving body 11). For example, referring to FIG. 4, in the case where the upper slope 23 is rectilinear, it may extend substantially in the longitudinal direction x, its direction D1 being able to form an angle $\alpha$1 less than 20 degrees relative to a horizontal plane (x, y) denoted P. In all cases, a trade-off is chosen for the form of the protrusion and of the piston with which it cooperates to obtain the optimum release operation.

In addition, and with reference to FIG. 6, the articulation axis 14 may be formed in an overall cylindrical piece apart from the portion provided with the protrusion 21. The ratio between the radius r1 of the articulation axis at the summit 22 of the protrusion 21 and the radius r2 over the rest of the articulation axis 14, measured notably in the direction oriented towards the front of the heelpiece, may be greater than 1.5, even greater than 1.7: these choices represent a good trade-off, make it possible to use a spring of low stiffness and achieve a lower boot release force. This force is that to be applied to the end of the moving body 11 to manually control the transition from the closed position to the open position of the heelpiece 10. This trade-off facilitates the use by the skier, while retaining the usual release thresholds as defined by the standard ISO 9462. As an example, the radius r1 may be of the order of 18 mm whereas the radius r2 may be of the order of 10 mm.

Figure 5:
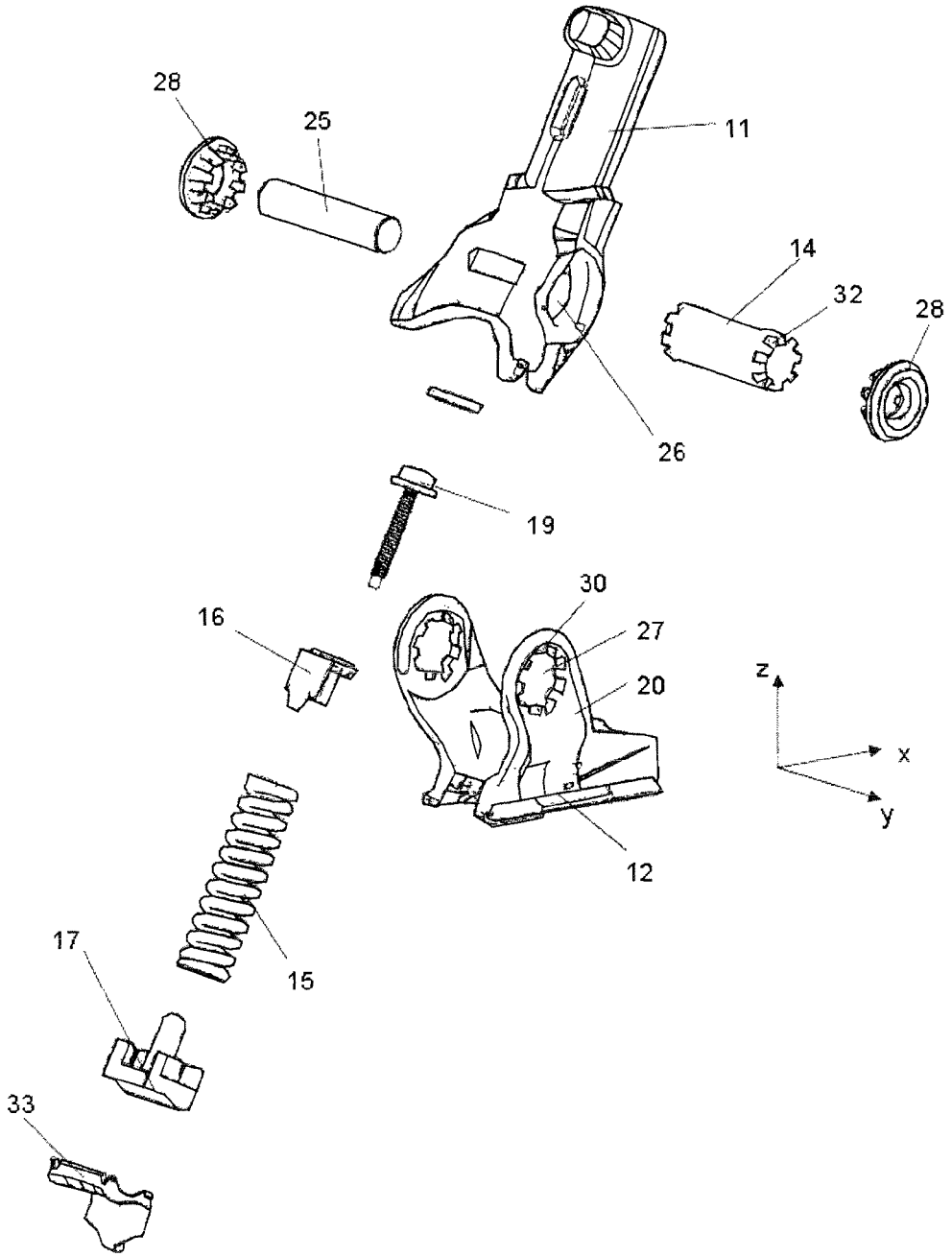
FIG. 5 is an exploded view of the heelpiece in perspective.

In an embodiment that is advantageous in terms of weight and simplicity, and as illustrated in FIG. 5 for example, the articulation axis 14 may adopt an overall tubular form, i.e. internally delimiting a bore enabling it to receive a reinforcing insert 25, solid or hollow, arranged inside the axis 14, so as to reinforce the heelpiece 10.

This construction therefore makes it possible ultimately to provide relatively small dimensions for the section of the articulation axis 14, which reduces the torques transmitted to this axis since it reduces the lever arm effects. This reduction of the torques transmitted to this axis offers two advantages:

- it facilitates the removal of the boot from the heelpiece since the manual force needed is reduced, which makes the solution more user-friendly;
- it makes it possible to use a spring of lower stiffness for the implementation of the release mechanism, which makes it possible to use plastic and to reduce the weight of the heelpiece. Furthermore, the protrusion of the articulation axis described above amplifies this effect.

Thus, the heelpiece according to one embodiment uses a spring whose stiffness can be reduced by at least 50% compared to the traditional solutions. This stiffness is defined as a function of the release threshold to be achieved, identified by the standardized value Z in accordance with the standard ISO 9462 for the alpine ski fastenings. The stiffness is chosen from the following solutions:

- for a setting up to Z12, the release spring has a stiffness less than 200 N/mm, or even less than 150 N/mm, or even less than or equal to 120 N/mm. Such a spring makes it possible to obtain a release function that conforms to the standard, despite its low stiffness, lower than the traditional solutions of the prior art for which the spring has a stiffness greater than or equal to 230 N/mm for the same setting up to Z12;
- for a setting up to Z15, the spring has a stiffness less than 300 N/mm, or even less than 200 N/mm, or even less than or equal to 150 N/mm. Such a spring makes it possible to obtain a release function that conforms to the standard, despite its low stiffness, lower than the traditional solutions of the prior art for which the spring has a stiffness greater than or equal to 400 N/mm for the same setting up to Z15.

This reduction of the stiffness of the spring has an impact on the whole of the heelpiece, makes it possible to reduce the volume of the assembly comprising moving body, lateral arms, release mechanism, and cam, and finally to obtain a significant weight saving, of the order of 30% compared to the same elements of the moving body heelpieces of the prior art.

FIG. 9 also illustrates that the lateral arms 20 may delimit a space between the transversal ends of the protrusion 21 and themselves so as to be able to receive the moving body 11. FIG. 5 to this end shows that the moving body 11 is equipped, in its forward portion, with a housing that is globally closed apart from two openings 26 formed transversally in the lateral flanks of this housing in order to allow the axis 14 to pass through the moving body 11 from one side to the other through this housing. Each of the spaces between an arm 20 and a protrusion end 21 is intended to receive a lateral flank of the housing.

Figure 8:
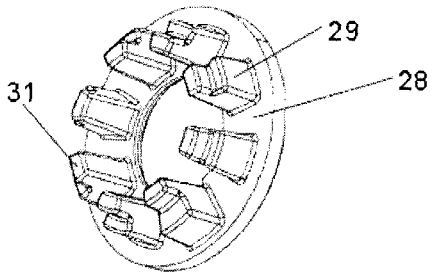
FIG. 8 is a perspective view of a stop washer.

Furthermore, the lateral arms 20 include openings 27 to receive the ends of the articulation axis. The latter is blocked transversally at the level of each lateral arm 20 by a stop washer 28 (illustrated in FIG. 8 in detail) fitted into the opening 27 of the arm. The internal face of the washer 28 is equipped, on its periphery, with rotation blocking elements 29, for example in the form of notches, cooperating with complementary blocking elements 30 arranged on the periphery of the opening 27 of the arms 20. Also, the internal face of each stop washer 28 is additionally equipped with additional blocking elements 31 on its external periphery, for example in the form of notches with a greater height than the first notches mentioned above, cooperating with complementary blocking elements 32 arranged on the external periphery of the ends of the articulation axis 14. The use of such washers with two series of blocking elements facilitates the fitting of all the pieces on the two lateral arms 20, notably the assembly of the pieces 14, 25, 26, 28 which can be seen in particular in FIG. 5 in exploded perspective view.

Figure 10:
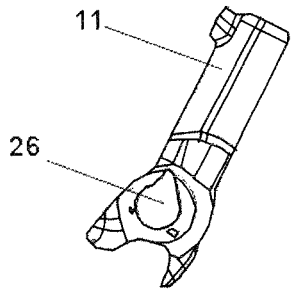
FIG. 10 represents a side view of the moving body of the heelpiece.

The procedure for fitting such a heelpiece comprises the following major steps: the articulation axis 14 is first inserted into the moving body 11 through the opening 26, then the moving body, after its finalized assembly, is force-fitted from above between the arms 20 which are elastically moved apart slightly during this operation, then the resulting assembly receives the insertion of the two washers 28 mentioned above for the rotation blocking explained previously. It should be noted that the articulation axis has a length slightly greater than the non-stressed spacing of the two arms 20. Furthermore, the openings 27 of the lateral arms 20 have a format that is independent of that of the articulation axis 14 which does not pass through when fitting the heelpiece, and may notably have a section that is smaller than that of the articulation axis at the level of its protrusion. On the other hand, the opening 26 of the moving body has a non-circular form to be able to receive the axis and its protrusion, as can be seen in particular in FIG. 10. Furthermore, this opening 26 is at least partially covered by the lateral arms 20 after the heelpiece has been fitted.

The solution thus retained and described above is suited to any boot fastening device with a moving body that moves about a suspended axis. It can notably be implemented on a longitudinally mobile carriage on a ski, and/or on a pivoting plate.

The invention claimed is:

1. A safety fastening heelpiece for a ski boot comprising a moving body mounted to pivot about an articulation axis suspended by two lateral arms linked to a base, the moving body including a release spring acting on a moving piston cooperating with a release surface of the articulation axis, so as to be able to occupy a first position corresponding to a closed position of the heelpiece in which a heel grip arranged at one end of the moving body is intended to hold the heel of the ski boot on a ski, and to be able to occupy a second position corresponding to an open position of the heelpiece, characterized in that the release surface is formed by a protrusion of the articulation axis arranged in relief relative to the rest of the articulation axis, said protrusion presenting an upper slope where the moving piston bears in the closed position of the heelpiece, and a summit forming a switchback point on which the piston remains pressed in the open position.

2. The fastening heelpiece according to claim 1, wherein the articulation axis is formed in an overall cylindrical piece, the ratio between the radius (r1) of the articulation axis at the summit of the protrusion and the radius (r2) over the rest of the articulation axis is greater than 1.5.

3. The fastening heelpiece according to claim 1, wherein the release spring (15) has a stiffness in accordance with at least one of the following properties:

for a setting up to Z12 of the heelpiece, the stiffness is less than 200 N/mm.

4. The fastening heelpiece according to claim 1, wherein the protrusion extends over at least a portion of the length of the articulation axis in the transversal direction y and extends longitudinally substantially towards the rear of the heelpiece.

5. The fastening heelpiece according to claim 1, wherein the moving body includes a through-opening of non-circular form to receive the articulation axis with its protrusion, and in that this opening is at least partially covered by one of the two lateral arms.

6. The fastening heelpiece according to claim 1, wherein, in a cross-sectional plane having a normal oriented in the transversal direction, the protrusion has an overall triangular section, with a rounded summit surrounded by two slopes, respectively upper and lower.

7. The fastening heelpiece according to claim 6, wherein the upper slope is rectilinear and extends substantially in the longitudinal direction (x).

8. The fastening heelpiece according to claim 7, wherein the direction (D1) of the upper slope forms an angle ($\alpha$1) less than 20 degrees relative to a horizontal plane (P).

9. The fastening heelpiece according to claim 6, wherein the lower slope is rectilinear and extends in an inclined direction (D2) approaching the base by going longitudinally towards the front of the heelpiece.

10. The fastening heelpiece according to claim 1, wherein the lateral arms delimit a space between the transversal ends of the protrusion and themselves so as to be able to receive a portion of the moving body.

11. The fastening heelpiece according to claim 1, wherein the lateral arms include openings to receive an end of the articulation axis.

12. The fastening heelpiece according to claim 11, wherein the openings of the lateral arms have a section that is smaller than the section of the articulation axis at the level of its protrusion so that this articulation axis cannot pass through one of the opening.

13. The fastening heelpiece according to claim 1, wherein the articulation axis is blocked transversally at the level of each lateral arm by a stop washer fitted into the opening of the arm, the washer being equipped, on the periphery of its internal face, with a double series of rotation blocking elements cooperating respectively with the elements for blocking the opening of the lateral arms and with the complementary blocking elements linked to the articulation axis.

14. The fastening heelpiece according to claim 1, wherein the articulation axis is made of plastic material, or of fibre-reinforced plastic material.

15. The fastening heelpiece according to claim 1, wherein the articulation axis adopts an overall tubular form and in that a reinforcing insert is arranged inside the articulation axis so as to reinforce the heelpiece.

16. The device for fastening a ski boot on a ski, comprising an abutment to receive the front portion of the ski boot, and wherein it comprises a heelpiece according to claim 1 to receive the rear portion of the ski boot.

17. The ski comprising a safety fastening heelpiece for ski boot according to claim 1.

18. The fastening heelpiece according to claim 1, wherein the articulation axis is formed in an overall cylindrical piece, the ratio between the radius (r1) of the articulation axis at the summit of the protrusion and the radius (r2) over the rest of the articulation axis is greater than 1.7.

19. The fastening heelpiece according to claim 1, wherein the release spring has a stiffness in accordance with at least one of the following properties:

for a setting up to Z12 of the heelpiece, the stiffness is less than 150 N/mm.

20. The fastening heelpiece according to claim 1, wherein the release spring has a stiffness in accordance with at least one of the following properties:

for a setting up to Z12 of the heelpiece, the stiffness is less than or equal to 120 N/mm.

21. The fastening heelpiece according to claim 1, wherein the release spring has a stiffness in accordance with at least one of the following properties:

for a setting up to Z15 of the heelpiece, the stiffness is less than 300 N/mm.

22. The fastening heelpiece according to claim 1, wherein the release spring has a stiffness in accordance with at least one of the following properties:

for a setting up to Z15 of the heelpiece, the stiffness is less than 200 N/mm.

23. The fastening heelpiece according to claim 1, wherein the release spring has a stiffness in accordance with at least one of the following properties:

for a setting up to Z15 of the heelpiece, the stiffness is less than or equal to 150 N/mm.

24. The fastening heelpiece according to claim 1, wherein the release surface is formed by the protrusion forming a volume in relief outside a cylinder in which the portion of the articulation axis is inscribed.

* * * * *